United States Patent [19]

Hansen

[11] Patent Number: 4,667,849

[45] Date of Patent: May 26, 1987

[54] COTTON-TIPPED SWAB DISPENSER

[76] Inventor: Russell A. Hansen, 501-A Lee Rd. - Apt. 902, Bedford, Ohio 44146

[21] Appl. No.: 823,184

[22] Filed: Jan. 27, 1986

[51] Int. Cl.[4] ..... B65D 83/02

[52] U.S. Cl. ..... 221/190

[58] Field of Search ..... 221/190, 192, 254

[56] References Cited

U.S. PATENT DOCUMENTS

| | | | |
|---|---|---|---|
| Re. 24,950 | 3/1961 | Wills | 221/192 |
| 245,116 | 8/1881 | Baker . | |
| 1,034,318 | 7/1912 | Sobretto et al. . | |
| 1,124,146 | 1/1915 | Kroll | 221/190 |
| 2,212,268 | 8/1940 | Ivanoff | 312/79 |
| 2,843,292 | 7/1958 | Baehr | 221/190 |
| 2,873,047 | 2/1959 | Cepero | 221/260 |
| 2,914,216 | 11/1959 | Gasparini | 221/190 |
| 3,306,494 | 2/1967 | Castner | 221/81 |
| 3,982,660 | 9/1976 | Hashimoto | 221/190 |
| 4,522,314 | 6/1985 | Nelson | 221/190 |

FOREIGN PATENT DOCUMENTS

| | | | |
|---|---|---|---|
| 1556764 | 12/1968 | France | 221/254 |

*Primary Examiner*—F. J. Bartuska

*Attorney, Agent, or Firm*—Body, Vickers & Daniels

[57] ABSTRACT

A dispenser for dispensing a cotton-tipped swab in an upright, vertical position, is comprised of a stationary base having an upright chamber concentric about an axis. A container for holding a plurality of swabs in a generally upright position is telescopically received within the chamber for vertical axial movement therein between an upper normal position and a lower dispensing position. The container further includes axially aligned, opposed upper and lower, conical surfaces each having an axially aligned opening at the apex thereof. An upstanding rod member extends upward from the stationary base through the aperature in the lower conical surface in a manner to effect riding movement therewith. The upstanding rod member includes a specially configured swab engaging upper end and an annular shoulder which contacts the lower conical opening, by spring bias, to maintain the dispenser in its normal position. When the chamber is pushed down, the swab engaging upper end moves into the container and engages a swab which is dispensed through the upper opening.

3 Claims, 7 Drawing Figures

FIG. 4
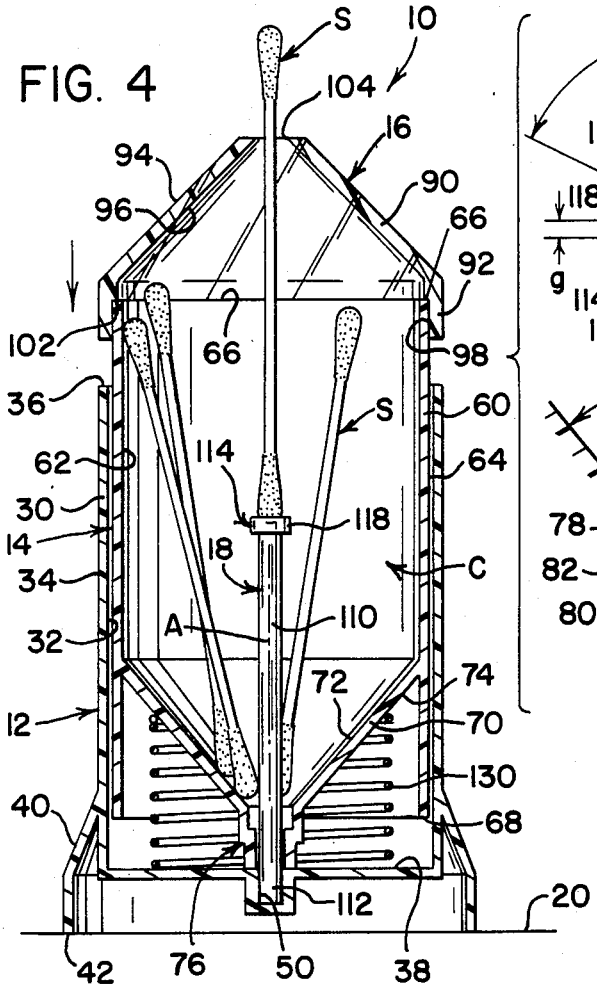
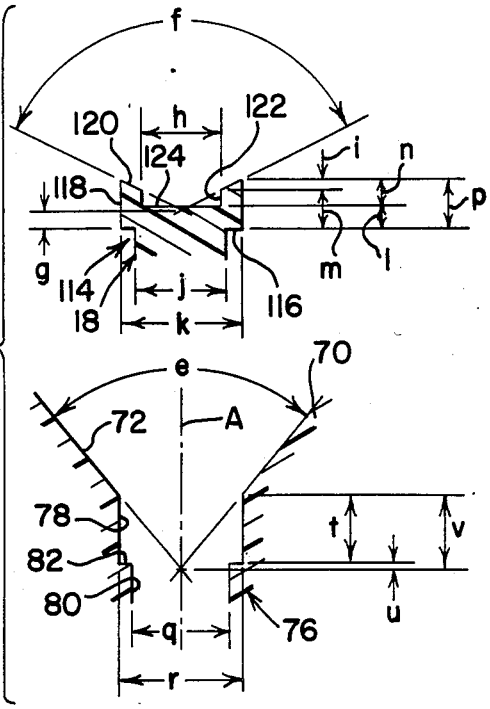
FIG. 6
FIG. 5
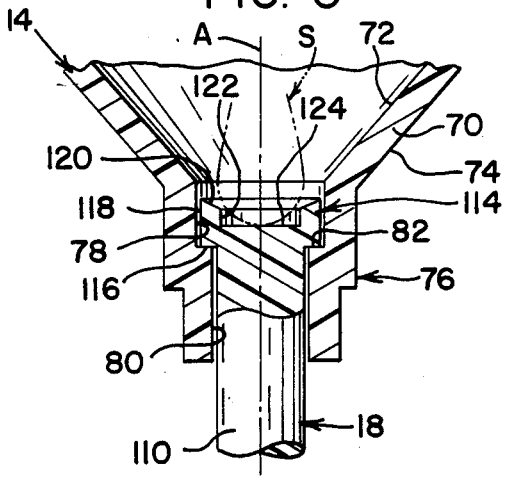
| | |
|---|---|
| a = 1.97" | k = .250" |
| b = 2.47" | l = .050" |
| c = 1.94" | m = .080" |
| d = 90° | n = .050" |
| e = 80° | p = .100" |
| f = 128° | q = .210" |
| g = .040" | r = .270" |
| h = .175" | t = .150" |
| i = .020" | u = .015" |
| j = .200" | v = .165" |
FIG. 7

COTTON-TIPPED SWAB DISPENSER

FIELD OF INVENTION

The present invention pertains to the art of dispensers, and more particularly to a dispenser for individually dispensing cotton-tipped swabs in an upright vertical position.

BACKGROUND OF THE INVENTION

Cotton-tipped swabs find advantageous application in numerous situations in both home and hospital environment. In this respect, in many instances it is desirable to have a swab readily available in an easily obtainable manner. To this end, the present invention provides a manually operable dispenser for dispensing individually cotton-tipped swabs in an upright position, which dispenser may be operated by merely pushing downward on a portion thereof. U.S. Pat. No. 3,306,494 to Castner discloses a device for dispensing an individual cotton-tipped swab horizontally. The swabs are individually spaced along a resilient carded strip, which strip is indexed to a dispensing position from which an individual cotton-tipped swab is dispensed. The device requires that the swabs be positioned along the resilient strip with a predetermined spacing therebetween. As will be appreciated, aligning the swabs in such a manner is a tedious and time consuming endeavor. In addition, the necessity to repeatedly index the carded strip requires a relatively accurate mechanical arrangement within the dispenser. Together these arrangements, i.e. to accurately space the swabs and to index same, create a relatively costly and complicated device.

The present invention, however, overcomes these problems and provides a cotton-tipped swab dispenser which is much simplier to operate, and which does not require an indexing arrangement or exact positioning of the swabs. In this respect, the present invention provides a dispenser wherein a plurality of swabs may be placed in random arrangement therein, and wherein swabs are dispensed individually by merely pushing downward on a portion of the dispenser. Still further, a dispenser according to the present invention has relatively few parts, which parts are easy to fabricate.

SUMMARY OF THE INVENTION

According to the present invention there is provided a dispenser for dispensing a cotton-tipped swab in an upright, vertical position. The dispenser is comprised of a stationary base having an upright chamber concentric about an axis. A container for holding a plurality of swabs in a generally upright position is telescopically received within the chamber for vertical, axial movement therein between an upper position and a lower position. The container further includes axially aligned, opposed upper and lower, conical surfaces each having an axially aligned opening at the apex thereof. An elongated rod member projects upward axially from the stationary base of the dispenser and extends through the aperture in the lower conical surface in a manner to effect riding movement therewith. The upstanding rod member includes a swab engaging upper end. Means biasing the container upwardly relative to the stationary base are provided therebetween. Means on the rod member are provided for limiting upward movement of the container thereon so as to position the swab engaging end at a predetermined position relative to the lower conical surface of the container.

More specifically, when the container is in the upper position the swab engaging upper end of the rod member is situated generally at, or slightly below, the apex of the lower conical surface. In this respect, the lower ends of the cotton-tipped swabs within the container, which swabs are maintained in a generally upright position, gravitate toward the apex of the lower conical surface wherein the lower end of one of the swabs comes to rest on the upper end of the rod member. When the container is pushed downward along the rod member, the swab resting thereon remains generally stationary relative to the downward moving container and the other swabs. As the container continues downward, the upper end of the stationary swab eventually engages the upper conical surface which guides the upper end toward the opening at the apex thereof. Further downward movement of the container forces the upper end of the stationary swab through the opening in the upper conical surface wherein it may be grasped and pulled from the dispenser. Upon release of the container, the biasing means returns same to the upper position wherein the lower end of another swab will gravitate to the dispensing position.

As will be appreciated, the relatively light weight of a cotton-tipped swab, together with the resiliency and adhering nature of the cotton ends of the swabs relative to each other, make precise movement and positioning of the swabs difficult. Thus, in accordance with another aspect of the present invention, to insure proper positioning and dispensing of the individual swabs, swab engaging means are provided at the upper end of the rod member. The swab engaging means are comprised of an upward facing, annular, conical surface, which surface slopes downward from the outer peripheral surface of the rod member into a cylindrical recess axially aligned with the rod member. The recess is dimensioned to maintain the cotton-tip therein in a manner such that the axis of the swab intersects the lower surface of the recess so as to retain the swab within the recess during the dispensing cycle.

An object of the present invention is to provide a device for dispensing individually cotton-tipped swabs.

Another object of the present invention is to provide a swab dispenser wherein the swab is dispensed in a vertical, upright position.

Another object of the present invention is to provide a dispenser as described above wherein the swabs to be dispensed may be inserted randomly therein, i.e. exact positioning or spacing of the swabs in the dispenser is not required.

A further object of the present invention is to provide a dispenser as described above, which dispenser may be manually operated by merely pushing downward on a portion thereof.

A still further object of the present invention is to provide a swab dispenser as described above which dispenser is inexpensive, has relatively few parts, and is simple and easy to use.

These and other objects and advantages of the present invention will become apparent from the following description of a species thereof taken together with the accompanying drawing.

BRIEF DESCRIPTION OF THE DRAWING

The invention may take physical form in certain parts and arrangement of parts, a preferred embodiment of which will be described in detail in this specification and illustrated in the accompanying drawing which forms a part hereof and wherein:

FIG. 4 is a cross-sectional elevation view showing the preferred embodiment in a swab dispensing configuration;

FIG. 5 is an enlarged sectional view illustrating the swab engaging upper end of the rod member together with the rod receiving portion of the container;

FIG. 6 is a dimensioned sectional view of the upper end of the rod member and the rod receiving portion of the container; and, FIG. 7 is a chart showing dimensions of several parameters of a preferred embodiment.

DETAILED DESCRIPTION OF THE PREFERRED EMBODIMENT

Figure 1:
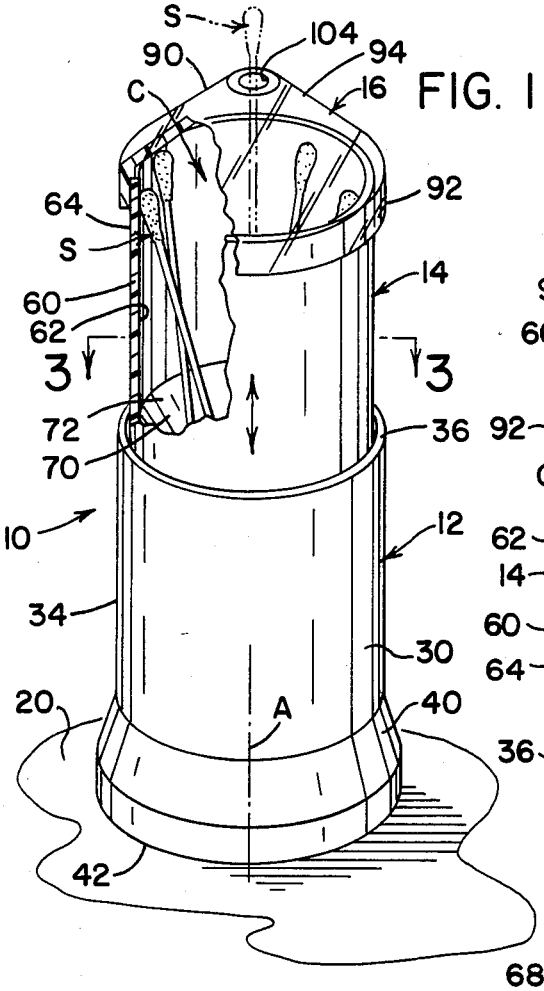
FIG. 1 is a partially sectioned, perspective view of a cotton-tipped swab dispenser illustrating a preferred embodiment of the present invention, which dispenser is illustrated in its normal configuration.

Referring now to the drawings wherein the showings are for the purpose of illustrating a preferred embodiment of the invention only and not for the purpose of limiting the same, FIG. 1 shows a cotton-tipped swab dispenser 10 positioned in its normal upright position on surface 20. Dispenser 10 is comprised of a base 12, a body 14 which is telescopically received by base 12, a cap member 16, and a rod member 18, best seen in FIG. 2.

Base 12 is generally cylindrical in shape and comprised of a cylindrical wall section 30 which is concentric about an axis A. Wall section 30 defines an inner surface 32, an outer surface 34, and an upper free end 36, and terminates at its lower end in a wall 38. An outwardly diverging wall section 40 is provided at the lower end of base 12, which wall section 40 has a planar end surface 42 for engagement with surface 20. A cylindrical cavity or recess 50 is provided in wall 38, which recess 50 is centrally located with respect to base 12 and axis A.

Body 14 is comprised of a cylindrical wall 60 having an inner surface 62 and an outer surface 64. Surfaces 66, 68 define the upper and lower ends of wall section 60 respectively. A conical wall 70 having an upper conical surface 72 and a lower surface 74 is provided in body 14 near the lower end of wall section 60. At the apex of conical wall 70, a cylindrical portion 76 is provided. An opening extends through cylindrical portion 76, which opening is comprised of bores 78, 80. Bore 78 is of a first diameter, while bore 80 which is below bore 78 is of a second, smaller diameter. The intersection of bores 78, 80 define an annular shoulder 82.

Cap 16 is comprised of a conical wall 90 having a lower cylindrical apron or rim 92 at the lower or opened end thereof. Conical wall 90 includes an outer surface 94 and an inner, conical surface 96. Apron or rim 92 includes a cylindrical inner surface 98. Apron 92 is recessed to define surface 102 therein. Surface 102 is dimensioned to snugly fit over surface 64 of cylindrical wall section 60. An opening 104 is provided at the apex of conical wall 90.

Rod member 18 is comprised of an elongated cylindrical portion 110 having a lower end 112 fixedly secured in recess 50 in wall 38. Rod portion 110 is cylindrical in cross-section to enable sliding movement within bore 80 of body 14. Swab engaging means are provided at the upper end of rod member 18 in the form of an enlarged or flared cylindrical portion 114. Cylindrical portion 114 includes a downward facing, annular surface 116, best seen in FIG. 5, and a cylindrical outer surface 118. An upward facing, annular, conical surface 120 slopes downward from surface 118 to a cylindrical recess 122 having a flat surface 124 generally perpendicular to axis A at the bottom thereof. As can be seen from FIG. 5, flared portion 114 is dimensioned to be received in bore 78 of body 12. In this respect, recess 122 is disposed in a predetermined position relative to conical surface 72. Importantly, downward facing surface 116 abuts shoulder 82 and as a result, limits upward movement of body portion 14 along rod member 18 A spring 130 shown in FIG. 3 is provided to bias body 14 upwardly with respect to base 12 to maintain body 14 in the configuration shown in FIGS. 1 and 2. Spring 130 is confined between lower end wall 38 of base 12 and conical wall 70 of body 14.

Figure 2:
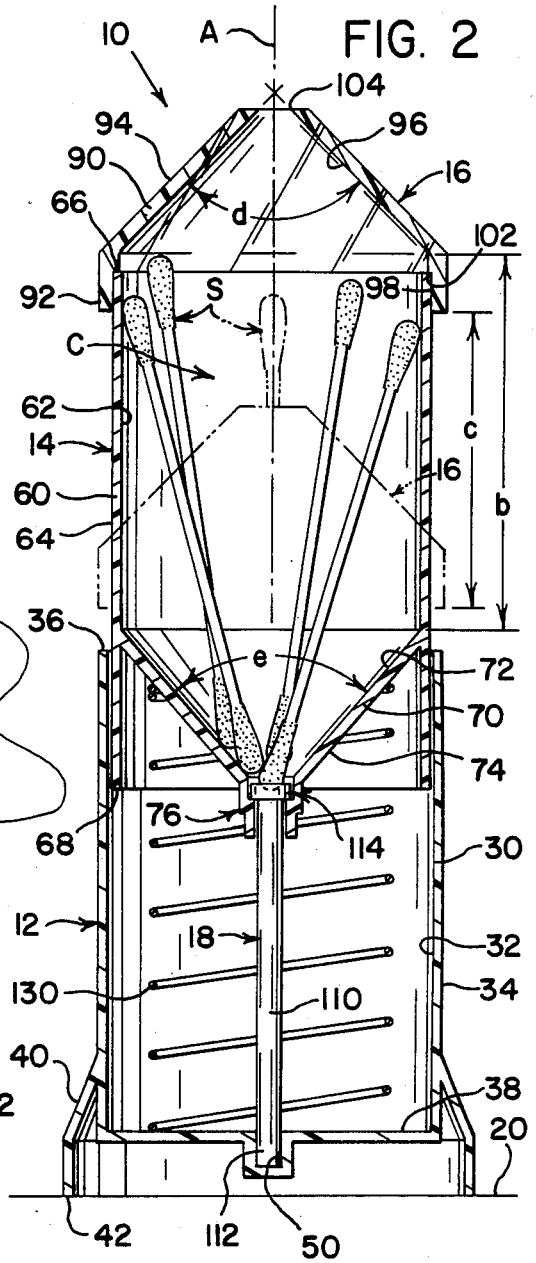
FIG. 2 is a cross-sectional, elevation view of the preferred embodiment in its normal configuration, and also illustrating a dispensing configuration thereof in phantom.
Figure 3:
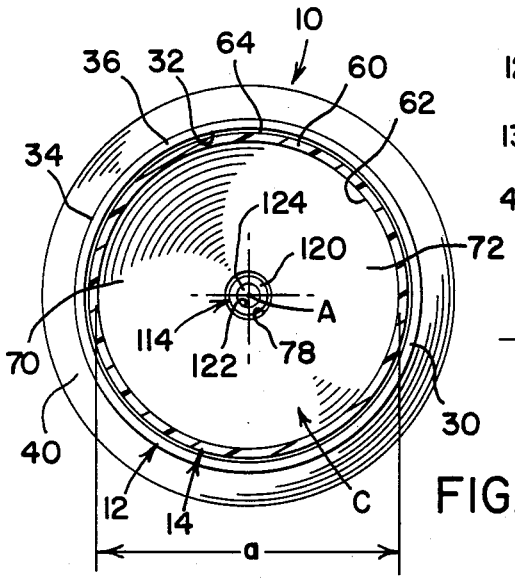
FIG. 3 is an enlarged cross-section view taken along line 3—3 in FIG. 1.

The assembled configuration of the preferred embodiment is best seen in FIG. 2. In this respect, body 14 and cap 16 define a container chamber C. More specifically, chamber C is defined by opposed conical surfaces 72, 96, and by surface 62 of cylindrical wall 60. As will be appreciated, body 14 is reciprocally movable along rod member 18 within base 12. Spring 30 biases body 14 to the uppermost position as shown in FIG. 2. Movement of body 14 along rod 18 is limited by engagement of flared, cylindrical portion 114 with shoulder 82. Importantly, cylindrical portion 114 not only acts as a stop, but also positions the swab engaging portion of rod 18 relative to surface 72. In this respect, the means which limit the telescopic movement of body 14 relative to base 12, also positions the swab engaging means at the proper position relative to conical surface 72. Accordingly, the device is accurately positioned to dispense each swab.

In operation, a plurality of cotton-tipped swabs may be placed within chamber C by removing cap 16 from body 14. As seen in the drawing, the cotton swabs are maintained in chamber C in a generally upright position. In this orientation the lower ends of swabs S gravitate toward the apex of the conical surface 72, until one of the swabs is positioned within recess 122 of rod member 18. As container 14 is pushed downward within base portion 12, the swab which is confined within the recess 122 remains stationary relative to the downward moving body 14. The upper end of the stationary swab slides along inner surface 62 of wall 60, and then along surface 96 of cap 16, and through hole 104, as shown in FIG. 4.

As will be appreciated, the dimensions of chamber C as well as the dimensions and configuration of the upper end of rod 18 are important to the operation of the present invention. In one respect, if the diameter of body 14 is too large, the cotton swabs will merely topple over, or the lower end thereof will not be maintained in recess 122 when being dispensed. Conversely, if the diameter is too small, only a limited number of swabs could be placed in chamber C. In another respect, the angles of conical surfaces 72, 96, and the spacing therebetween, are also important. For example, if the angle of lower conical surface 72 is too shallow, the swabs will not slide into recess 122. On the other hand, if the angle is too steep swabs within chamber C will interfere with the swab to be dispensed during movement of body 14. Likewise important is the swab engaging upper end of rod 18. Because of the relatively light weight of a cotton-tipped swab, as well as the adhering characteristic of a cotton tip in relation to another cotton tip, it is believed necessary to maintain the axis of the swab to be dispensed along an axis which intersects surface 124. In this manner, the end of the swab will be maintained in recess 122. Thus, as can be seen, the parameters of the dispenser are important and interrelated with regards to the operation of the present invention. Accordingly, the dimensions of an operative embodiment of the present invention are shown in the chart in FIG. 7. It should be understood that the present invention is not limited to a dispenser of the dimensions as set forth in FIG. 7. These dimensions are provided merely to disclose an operative embodiment of the present invention.

Further with respect to the embodiment shown in the Figures, the dispenser is preferably of molded plastic construction to provide smooth inner surfaces along which the cotton tips of the swabs can slide. In this respect, numerous compositions of plastics will find advantageous application to the present invention. The composition of the plastic in and of itself is not critical to the present invention. Preferably cap 16 is transparent to allow visual inspection of the number of swabs within chamber C.

The invention has been described with reference to a preferred embodiment. Obviously, other modifications and alterations will occur to those skilled in the art on reading and understanding of the specification. It is intended that all such modifications and alterations be included insofar as they come within the scope of the invention as claimed or the equivalence thereof.

Having thus described the invention, it is claimed:

1. A dispenser for dispensing a cotton-tipped swab in an upright, vertical position, comprising:

a stationary base having an upright cylindrical chamber concentric about an axis, said chamber having a bottom and opened upper end;

a cylindrical body for containing a plurality of swabs in a generally upright, vertical position, said body telescopically received within said chamber for vertical, axial movement therein between a normal upper position and a swab dispensing lower position, and having an open, upper end and a closed, lower end, said lower end including a downward sloping conical surface having a first axially aligned bore of predetermined diameter at the apex thereof, said first bore communicating with a second axially aligned bore of smaller diameter to define an upward facing annular surface;

a cap providing a closure for said open end of said body, said cap having an inner conical surface with an opening at the apex thereof, said opening axially aligned with bores in said body;

means disposed within said chamber biasing said body upward;

an upstanding rod member having a free end with an outer cylindrical surface of diameter approximately equal to said first axially aligned bore of said cylindrical body, a smaller cylindrical portion of diameter approximately equal to the diameter of said second axially aligned bore of said cylindrical body depending from said free end and extending to said base, and a downwardly facing annular surface defined by the intersection of said outer cylindrical surface with said smaller cylindrical portion, said free end and said smaller cylindrical portion positioned within said bores of said cylindrical body so that in the normal position said downwardly facing annular surface is in contact with said upward facing annular surface and as said cylindrical body is moved downward said free end engages the lower end of an upright swab and forces the upper end thereof through said opening in said cap;

said free end of said rod member further defined by a downwardly flared frusto-conical surface intersecting at its larger base with said outer cylindrical surface to define an annular edge at the uppermost portion of said free end and intersecting, at its smaller base with a cylindrical recess, said recess terminating in a generally flat, circular surface having a diameter slightly greater than the dimension of a swab cotton tip, said annular edge disposed below the intersection of said downward sloping conical surface with said first axially aligned bore when the dispenser is in the normal position, and the included angle of said frusto-conical surface being greater than the included angle of said downward sloping conical surface of said cylindrical body.

2. A dispenser as defined in claim 1 wherein said angle of said frusto-conical surface is approximately 128°, said angle of said downward sloping conical surface of said cylindrical body is approximately 80° and the angle of said inner conical surface of said cap is approximately 70°.

3. A dispenser as defined in claim 2 wherein said outward cylindrical surface of said free end is approximately 0.250″, the diameter of said generally flat circular surface of said free end is approximately 0.200″ and the distance between said annular edge and the intersection of said downward sloping conical surface with said first axially aligned bore when the dispenser is in said normal position is approximately 0.050″.

* * * * *